United States Patent [19]

Bender

[11] Patent Number: 4,787,860

[45] Date of Patent: Nov. 29, 1988

[54] CONNECTOR SYSTEM HAVING COMBINED LATCH AND POLARIZATION MEMBER

[75] Inventor: Frederick A. Bender, Etters, Pa.

[73] Assignee: E. I. Du Pont de Nemours and Company, Wilmington, Del.

[21] Appl. No.: 90,556

[22] Filed: Aug. 28, 1987

[51] Int. Cl.[4] ..... H01R 13/639; H01R 13/648

[52] U.S. Cl. ..... 439/358; 439/607; 439/680

[58] Field of Search ..... 439/347, 350–352, 439/355, 357–358, 677, 680, 607

[56] References Cited

U.S. PATENT DOCUMENTS

| | | | |
|---|---|---|---|
| 3,409,858 | 11/1968 | Krehbiel | 339/91 |
| 3,530,424 | 9/1970 | Gregory | 439/357 |
| 3,611,261 | 10/1971 | Gregory | 339/91 R |
| 3,781,760 | 12/1973 | Mancini et al. | 339/59 M |
| 4,316,647 | 2/1982 | Bailey et al. | 339/91 R |
| 4,337,989 | 7/1982 | Asick | 339/143 R |
| 4,416,501 | 11/1983 | Fusselman et al. | 339/97 R |
| 4,448,471 | 5/1984 | Berry et al. | 339/91 R |
| 4,449,778 | 5/1984 | Lane | 339/143 R |
| 4,603,936 | 8/1986 | Jagen | 339/143 R |
| 4,639,061 | 1/1987 | Muzslay | 439/680 |
| 4,640,566 | 2/1987 | Matsusaka | 439/350 |
| 4,641,902 | 2/1987 | Fusselman | 339/91 R |

*Primary Examiner*—John McQuade

[57] ABSTRACT

A plug and receptacle combination having a compact configuration includes a plug having a slot for receiving a raised key-like projection on the receptacle to effect a polarization function and a flush-mount latch co-aligned with the slot to resiliently engage an opening in the projection to releasably latch the plug into engagement with the receptacle. The receptacle is designed to be telescopically received within the end of the plug to provide a high degree of shielding integrity. The plug is assembled from upper and lower half-shells that retain a connection block containing contacts of a first type, and the receptacle is defined by inter-engaging inner and outer shells which retain a connection block containing contacts of a second type for inter-engaging the contacts of the first type. A resilient spring is provided on the receptacle on the side opposite the raised key-like projection to assist in maintaining the plug and receptacle in mechanical and electrical engagement with one another.

11 Claims, 2 Drawing Sheets

CONNECTOR SYSTEM HAVING COMBINED LATCH AND POLARIZATION MEMBER

BACKGROUND OF THE INVENTION

The present invention relates to connectors and, more particularly, to connectors and mating headers that have a polarized relationship and which can be latched into engagement with one another.

Various types of electrical connector systems use a plug and cooperating header or receptacle which are designed to be mechanically latched together. In some systems, internally threaded sleeves are mounted on the plug and cooperate with an externally threaded receptacle to effect a threaded connection between the parts, and, in other systems, a bayonent-type arrangement is provided to allow a 'push-and-twist' type engagement. In those connectors used in consumer and commercial products, molded plastic latches are oftentimes provided on the plug to engage the receptacle. For example, the plug disclosed in commonly assigned U.S. Pat. No. 4,641,902 to Fusselman uses finger-operated latch arms that are pivotally mounted to the plug body at their mid-point. A latch tab is provided at the end of each arm to engage a ledge formed on the receptacle. While the latches perform their intended function, they are mounted so as to extend outwardly of the plug and thus limit the size of the minimum design 'envelop'. In addition to connector systems in which the two components are latched together, various polarizing arrangements are known to insure that a plug engages its receptacle in only one possible alignment. A common polarizing arrangement provides some type of key on one of the components and a keyway on the other component to effect the desired alignment. In many applications that require latchable and polarized connections, it is also a requirement that the associated cabling be shielded to prevent EMI emission and that the shielding function not be compromised by the connector system. Oftentimes, a connector system which provides polarization, shielding, and latching functions represents a connector that is less than optimally compact and, accordingly, presents design constraints that limit the number and type of applications for the connector system.

SUMMARY OF THE INVENTION

In view of the above, it is an object of the present invention, among others, to provide an improved connector system of compact design which effects both a polarized and latched engagement.

It is another object of the present invention to provide a connector system in which a plug and a cooperating receptacle are connected in a polarized and latched relationship and in which the latching and polarizing functions are combined in a common structure.

It is still another object of the present invention to provide an improved connector system of compact design which effects polarized and latched engagement and maintains effective shielding of the circuits connected through the connector system.

In view of these objects, and others, a connector system in accordance with the present invention includes first and second connector member having respective electrical contacts inter-engageable with one another. One of the connector members includes a polarizing projection for engaging a projection-receiving slot in the other member to provide a polarization function. A latching member is mounted to the other member and operates to engage the polarizing projection to provide a combined latching and polarizing function. The connector members are formed so that one member has an opening into which the other member is telescopically received to provide an improved shielding function when the two components are engaged and latched.

A preferred embodiment of a connector system includes a plug and cooperating receptacle with the plug having an open end into which the receptacle is telescopically received to provide a high degree of shielding integrity. The receptacle includes a raised, key-like polarizing projection, and the plug includes a slot for receiving the key-like projection on the receptacle to effect a polarization function. A user-operated latch is pivotally mounted on the plug and includes a latch arm co-aligned with the slot to resiliently engage an opening in the projection to releasably latch the plug into engagement with its receptacle. A recess is provided on the side of the plug to accept the latch arm to provide a compact flush-mounted arrangement. The plug is preferably fabricated for metal and assembled from upper and lower half-shell members that contain a connection block with contacts of a first type, such as square or cylindrical pins, and includes an interior cavity or pocket for receiving the mounting fulcrum of the latch. The receptacle is defined by inter-engaging inner and outer shells which contain another connection block with contacts of a second type, such as pin-receiving receptacles, for inter-engaging the contacts of the first type. A resilient spring is provided on the receptacle on the side opposite the raised key-like projection to assist in maintaining the plug and receptacle in electrical and mechanical engagement with one another.

The present invention advantageously provides a compact and efficient connector system in which the latching and polarizing functions are provided in a physically compact envelop with a high degree of shielding integrity.

Other objects and further scope of applicability of the present invention will become apparent from the detailed description to follow, taken in conjunction with the accompanying drawings, in which like parts are designated by like reference characters.

DESCRIPTION OF THE PREFERRED EMBODIMENT

Figures 1, 1A, 2:
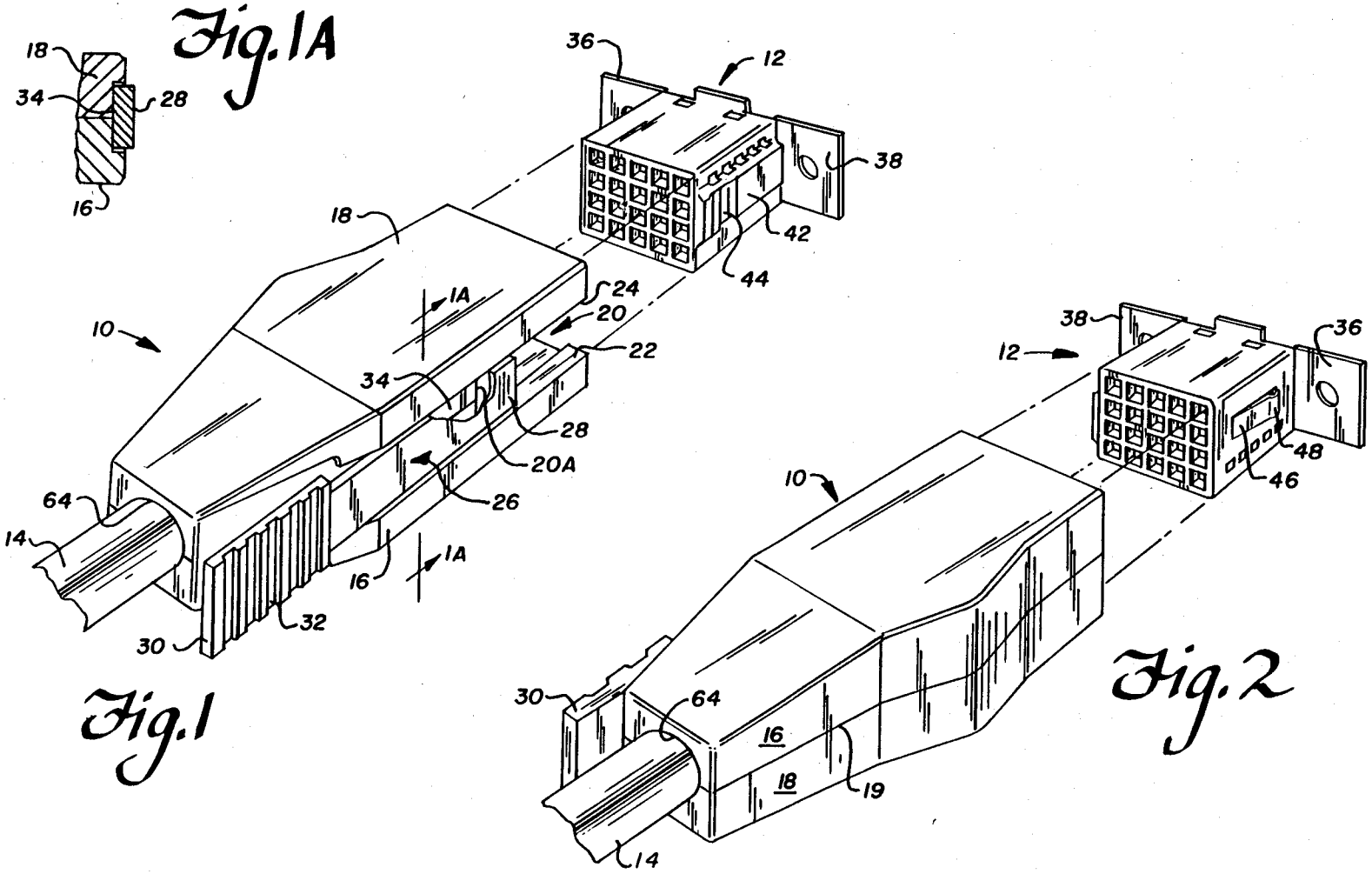
FIG. 1 is an isometric projection of a plug and cooperating receptacle in accordance with the present invention with a selected portion of a latch arm broken away for reasons of clarity.
FIG. 1A is a partial detail, in cross-section, of a flush-mounted latch arm taken along line 1A—1A of FIG. 1.
FIG. 2 is an isometric projection of the plug and receptacle of FIG. 1 from the side opposite that shown in FIG. 1.

A connector system in accordance with the present invention is shown in FIGS. 1 and 2 and includes a plug 10 and cooperating receptacle 12. The plug 10 terminates the end of a multi-conductor cable 14 and is assembled, as described in more detail below, from first and second metal half-shells 16 and 18 having coterminous surfaces that mate along a medial line 19. As shown in FIG. 1, the plug 10 includes a forwardly facing slot 20 on one side thereof defined by a surface 22 of the half-shell 16 and an opposing surface 24 of the half-shell 18. The slot 20 extends generally in the longitudinal direction of the plug 10 and is terminated at its rearward end by a surface 20A (partially illustrated in FIG. 1). The slot 20, as described below, assists in performing both a polarizing function and a latching function. A user-operated latch member, designated generally by the reference character 26, is mounted intermediate its ends to the assembled half-shells 16 and 18, as explained below in relationship to FIG. 3, and includes a forwardly extending arm 28 and rearwardly extending arm 30. Striations 32 are provided on the rearwardly extending arm 30 to facilitate manual operation of the latch member 26. The sidewall of assembled half-shells 16 and 18 rearwardly of the slot 20 includes a recess or guideway 34, best shown in the detail of FIG. IA, which accepts the forwardly extending arm 28 of the latch member 26 to provide a desirable 'flush' mounting arrangement which contributes to the compact configuration of the plug 10.

The receptacle 12 is formed as a block-like structure and is dimensioned to be telescopically received within the open, forward end of the plug 10 and has, in the case of the preferred embodiment, laterally extending mounting flanges 36 and 38 used for bulk-head type mounting applications. The flanges 36 and 38 can include openings (unnumbered) for receiving various fasteners. As shown in FIG. 1, a raised key-like projection 42 is formed on one side of the receptacle 12. The projection 42 has a length dimension substantially equal to the depth of the receptacle 12 and a width dimension that is somewhat less than the dimension between the opposed surfaces 22 and 24 of the projection-receiving slot 20 of the plug 10. The dimensional relationship between the projection 42 and the slot 20 is such to allow a clearance-type sliding fit between the plug 10 and the receptacle 12 with the slot 20 accommodating substantially the entire length of the raised projection 42. The projection 42 is formed with a latching indentation or slot 44 adjacent the end facing the plug 10. The latching slot 44 is designed to engage the forward arm 28 of the latch member 26 to releasably latch the components together, as explained below. As shown in FIG. 2, the opposite side of the receptacle 12 includes a resilient leaf spring 46 that extends laterally outward of the side of the receptacle 12 and includes a rounded nub 48 at its remote end.

Figure 3:
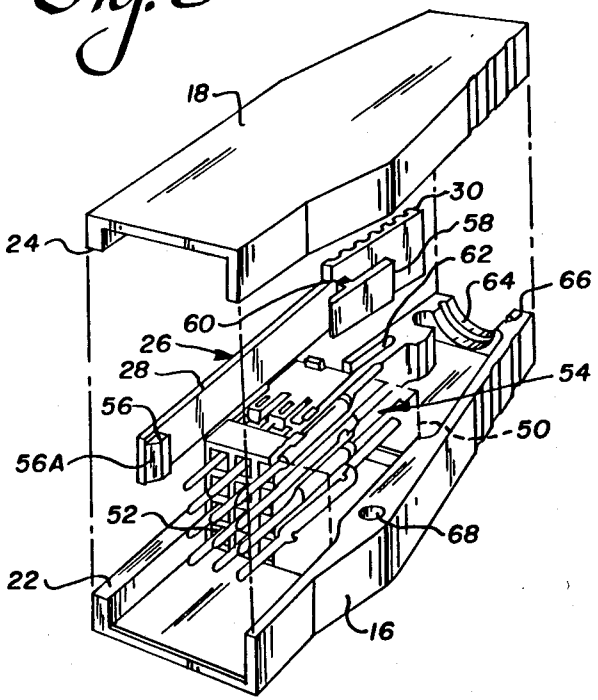
FIG. 3 is an exploded isometric view of the plug of FIGS. 1 and 2 in which a connector block has been partially broken away for reasons of clarity.

As shown in the exploded view of FIG. 3, the half-shells 16 and 18 define interior cavities which retain a plastic connector block 50 having a rectangular array of forwardly extending pins 52. The connector block 50 is set back from the forward, open end of the plug 10 to define a cavity (unnumbered) that receives the receptacle 12. In the preferred embodiment, the connector block 50 includes cylindrical or square crimp-to-wire pins 52 fitted to Mini-Latch Housings, designated generally by the reference character 54, marketed under the BergCon System trademark by DuPont Connectors Systems of New Cumberland, PA 17070. The housings 54 include tabs (unnumbered) which engage appropriate tab-receiving slots or recesses (not shown) formed in the interior surfaces of the half-shells 16 and 18 to maintain the housings 54 in place within the plug 10.

The latch member 26 includes a tab 56 at its forward end that faces and extends into the slot 20 and which is designed to enter the slot 44 adjacent the forward end of the projection 42 of the receptacle 12. An attachment member 58 joins with the forward and rearward arms 28 and 30 of the latch member 26 through a flex-hinge 60. The latch member 26 is preferably molded as a unitary structure from a flexible plastic, such as a polycarbonate or nylon. Both of the upper and lower half-shells 16 and 18 include a slot-like pocket 62 shown only in the half-shell 16 of FIG. 3) Which, when the half-shells 16 and 18 are assembled, define an interior cavity in the side of the plug 10 to retain the attachment member 58 in place. An opening (unnumbered) is provided in the sidewall of the half-shells 16 and 18 through which the flex-hinge 60 extends to maintain the latch member 26 in position on the side of the plug 10 with the forwardly extending arm 28 positioned in its recess 34 as shown in FIG. 1A. The structure of the latch member 26 and its mounting arrangement is described in commonly assigned U.S. Pat. No. 4,641,902 to Fusselman, the disclosure of which is incorporated herein by reference to the extent necessary to practice the present invention.

The rearward end of the upper and lower half-shells 16 and 18 include respective semi-circular openings 64 which, when the half-shells are assembled, define a circular opening through which the cable 14 extends into the plug 10. A groove 66 (FIG. 3) is formed in the wall surface that defines each semi-circular opening 64 and is designed to accept a U-shaped retaining clip (not shown) which retains the cable 14 in place. The cable 14 is typically shielded by a woven wire braid or helical foil wrapping to prevent EMI emissions. The U-shaped retaining clip is designed to penetrate the outer insulation of the cable 14 and contact the shield to physically retain the cable 14 in place as well as establish a ground connection with assembled half-shells 16 and 18. A suitable retaining clip system is described in commonly assigned U.S. Pat. No. 4,416,501 to Fusselman, the disclosure of which is incorporated herein by reference to the extent necessary to practice the present invention. As can be appreciated, other cable retaining devices may likewise be used in the plug 10. The half-shells 16 and 18 are assembled together by staked pins, that is, a pin or pins (not shown in the figures) is mounted in the sidewall of one half-shell and pressed into respective pin-receiving bores 68 (FIG. 3) in the other half-shell. When a staked-pin fastening arrangement is used, the wall thickness in the region adjacent the connecting pins and their pin-receiving bores is thickened somewhat, as shown in FIG. 3, to provide enhanced structural integrity.

Figure 4:
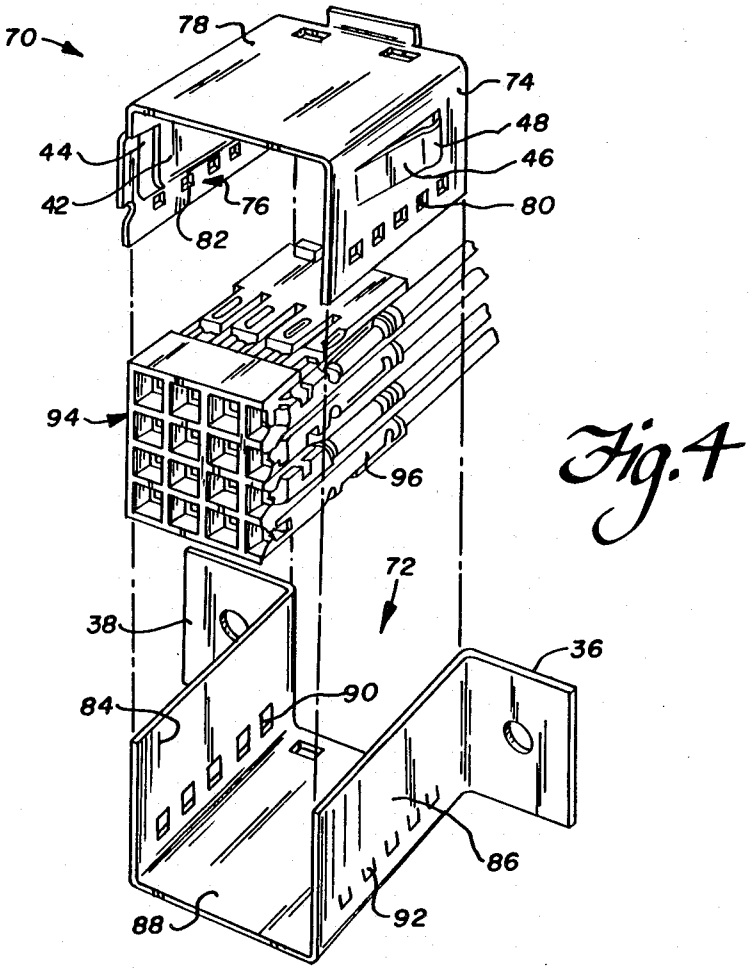
FIG. 4 is an exploded isometric view of the receptacle of FIGS. 1 and 2 in which a connector block has been partially broken away for reasons of clarity.

The receptacle 12, as shown in FIG. 4, is assembled from inner and outer shells 70 and 72 which may be formed from pressed metal sheet stock. The inner shell 70 includes opposed sides 74 and 76 and an intermediate panel 78. The above-described leaf spring 46 is formed integrally with the side 74 which also includes a row of apertures 80 adjacent its lower edge, the function of which is described below. The key-like projection 42 and its latching slot 44 is integrally formed in the side 76. The side 76 also includes a row of apertures 82 adjacent its lower edge. The outer shell 72 includes opposed sides 84 and 86 and an intermediate panel 88 with the mounting flanges 36 and 38 formed with the sides 84 and 86, respectively. Outwardly extending locking tabs 90 and 92, respectively, are formed on the sides 84 and 86. The inner and outer shells 70 and 72 engage one another with the tabs 90 and 92 engaging and extending partly into the apertures 82 and 80 to retain the two shells together. A plastic connector block 94, shown in partial break-away in FIG. 4, is captured between the inner and outer shells 70 and 72. The connector block 94 contains contacts designed to engage those of the connector block 50 of the plug 10. In the preferred embodiment, crimp-to-wire receptacles 96 are fitted to housings of the type described above.

In order to engage the plug 10 with its receptacle 12, the plug 10 is aligned in general registration with the receptacle 12 with the polarizing slot 20 facing the key-like projection 42. The receptacle 12 is telescopically received within the open end of the plug 10 with the parts pressed together to cause the projection 42 to enter and slide into the polarizing slot 20. The rounded nub 48 of the leaf spring 46 frictionally engages the opposite interior surface of the plug 10 to assist in maintaining a mechanical and electrical connection between the plug 10 and the receptacle 12. As the plug 10 is pressed into engagement with the receptacle 12, the tab 56 presents a forwardly facing ramp surface 56A (FIG. 3) that engages and rides up onto the projection 42 until the tab 56 clears and enters the slot 44 to latch the plug 10 into engagement with the receptacle 12. The organization of the plug 10 and receptacle 12 is such that the receptacle 12 is telescopically received within the opening at the forward end of the plug 10 to completely envelop the receptacle 12 and thus provide a high degree of shielding integrity. Since the plug 10 is fabricated from a metal, as are the inner and outer shells 70 and 72 of the receptacle 12, the electrical circuit paths joined through the plug 10 and its connected receptacle 12 are fully and reliably shielded to prevent EMI emissions from those circuits or, conversely, EMI emissions from affecting signals carried by the connected circuits.

In order to disengage the plug 10 from its connected receptacle 12, the rearward end of the plug 10 is grasped and the rearwardly extending arm 30 of the latch member 26 is pressed toward the body of the plug 10 causing the forwardly extending arm 28 to pivot outwardly at the flex-hinge 60 and retract the tab 56 from the tab-receiving slot 44 of the projection 42. Once the tab 56 is disengaged, the plug 10 is pulled to separate the plug 10 from the receptacle 12.

The present invention advantageously provides a compact and efficient connector system in which the latching and polarizing functions are provided in a compact arrangement having a high degree of shielding integrity. The latch member is desirably flush mounted to the plug body to provide a compact overall configuration.

Thus it will be appreciated from the above that as a result of the present invention, a connector system having a combined latch and polarization member is provided by which the principal objectives, among others, are completely fulfilled. It will be equally apparent and is contemplated that modification and/or changes may be made in the illustrated embodiment without departure from the invention. Accordingly, it is expressly intended that the foregoing description and accompanying drawings are illustrative of preferred embodiments only, not limiting, and that the true spirit and scope of the present invention will be determined by reference to the appended claims and their legal equivalent.

What is claimed is:

1. An electrical connector system having combined latch and polarization means comprising:

a first connector member having a plurality of electrical contacts therein of a first type;

a second connector member having a plurality of electrical contacts therein of a second type of effecting electrical connection with the electrical contacts of the first type of said first connector member, said first and second connector members inter-engageable with one other to effect connection between said first and second contact types;

raised projection means associated with a one of said first and second connector members;

means associated with the other of said first and second connector members defining a slot for accepting said raised projection means and for polarizing the alignment of the first and second connector members in a preferred alignment; and latching means mounted on the other of said first and second connector members and co-aligned with said slot for releasably latching the first and second connector members together, said latching means engaging the raised projection means of the one connector member to latch the members together, whereby said raised projection means, said latching means and said slot provide said combined latch and polarization means.

2. The connector system of claim 1, wherein said first connector member comprises:

a plug body formed of metal and having a connector block therein containing the electrical contacts of the first type, said plug body having an opening at one end of accepting said second connector member, said plug body having surface means defining said slot for receiving said raised projection means of said second connector member, an a latch arm movable between latching and unlatching positions for engaging said raised projection means when said raised projecting means is received in the slot.

3. The connector system of claim 2, wherein said second connector member comprises:

a receptacle body formed of metal and having a connector block therein containing the electrical contacts of the second type, said receptacle body having surface means defining said raised projection means for insertion into the slot of the plug body and means for receiving said latching means to latch said plug body and receptacle body together.

4. The connector system of claim 3, wherein said receptacle body is telescopically received within the opening at the one end of said plug body to provide shielding of circuits paths formed by the electrical connecting of the plurality of the first and second types of electrical contacts.

5. A connector system comprising:

a plug body formed of metal and having a connector block therein containing electrical contacts of a first type, a latch member movable between latching and unlatching positions, and surface means defining a polarizing slot; and a receptacle body formed of metal and having a connector block therein containing electrical contacts of a second type for engaging said contacts of the first type, said receptacle body having surface means defining a projection for insertion into the polarizing slot of said plug body, said projection having means engageable by said latching member to latch said plug body and receptacle body together, thereby combining the latching and polarizing functions in a common structure.

6. The connector system of claim 5, wherein said plug body has an opening at one end into which said receptacle body is telescopically received to effect engagement between and shielding said contacts of the first and second type.

7. The connector system of claim 5, wherein said latch member comprises:

an arm pivotally mounted intermediate its ends to said plug body and having a first arm portion for engaging said projection to effect latching and unlatching and a second arm portion manipulatable by a user to move said first arm portion into and out of engagement with said projection.

8. The connector system of claim 7, further comprising a recess formed in said plug body and into which at least said first arm portion is retained.

9. The connector system of claim 7, further comprising a tab formed at the remote end of said first arm portion for engaging said projection.

10. The connector system of claim 9, wherein said projection has a slot formed therein for accepting said tab.

11. The connector system of claim 7, further comprising:

spring means mounted to said receptacle body on the side thereof opposite said projection to assist in maintaining said plug body and receptacle body in mechanical and electrical engagement with one another.

* * * * *